US005766319A

United States Patent [19]

Kogelschatz

[11] Patent Number: 5,766,319

[45] Date of Patent: Jun. 16, 1998

[54] ELECTROFILTER

[75] Inventor: Ulrich Kogelschatz, Hausen, Switzerland

[73] Assignee: ABB Research Ltd., Zurich, Switzerland

[21] Appl. No.: 674,713

[22] Filed: Jul. 2, 1996

[30] Foreign Application Priority Data

Jul. 3, 1995 [DE] Germany ..... 195 24 214.9

[51] Int. Cl.[6] ..... B03C 3/66

[52] U.S. Cl. ..... 96/75; 96/76; 96/96; 96/97

[58] Field of Search ..... 96/75, 76, 96, 96/97, 74, 52, 53; 95/79–81

[56] References Cited

U.S. PATENT DOCUMENTS

| | | | |
|---|---|---|---|
| 4,209,306 | 6/1980 | Feldman et al. | 95/80 |
| 5,037,456 | 8/1991 | Yu | 96/96 X |
| 5,567,226 | 10/1996 | Lookman et al. | 96/74 X |

FOREIGN PATENT DOCUMENTS

| | | | |
|---|---|---|---|
| 464858 | 12/1928 | Germany | 96/75 |
| 36 09 698 | 9/1987 | Germany . | |
| 37 08 508 | 9/1988 | Germany . | |
| 274364 | 12/1989 | Germany | 96/75 |
| 256731 | 11/1969 | U.S.S.R. | 95/80 |

OTHER PUBLICATIONS

*Dubbel*, "Taschenbuch für den Maschinenbau", W. Beitz et al., 1990, pp. L54, L55.

*Journal of the Air Pollution Control Association*, "Conditioning of Fly Ash with Ammonia", E. Dismukes, vol. 25, No. 2, pp. 152–156, 1975.

*Primary Examiner*—Richard L. Chiesa
*Attorney, Agent, or Firm*—Burns, Doane, Swecker & Mathis, L.L.P.

[57] ABSTRACT

In electric filters with a negative corona, an aerosol is formed in the entrance area if ammonia is present in the flue gas, reducing the separation performance of the filter. To avoid this, spray electrodes and separation electrodes provided in the entrance area of the filter are wired so that a positive corona forms there. In sections downstream in the flow direction of the gas, spray electrodes and separation electrodes are wired such that a negative corona forms there.

3 Claims, 1 Drawing Sheet

ELECTROFILTER

TECHNICAL FIELD

The invention relates to an electric filter, in particular for flue gases containing ammonia, with surface separation electrodes—and spray electrodes connected to a high-voltage source.

Electric filters of this type are known, e.g., from Dubbel's "Taschenbuch für den Maschinenbau," Springer-Verlag Berlin, Heidelberg, New York, 17th Edition 1990, Page L 54, Illustration 19.

TECHNOLOGICAL BACKGROUND AND STATE OF THE ART

Electric filters use spray electrodes supplied with a negative direct voltage of several multiples of 10,000 Volts (a negative corona) to ionize the flue dust entrailed in the flue gas and deposit it on the separation electrodes (grounded plates). The latter form narrow paths in whose center the spray electrodes are suspended inside frames. Both electrodes are regularly cleaned with beater devices. Electric filters are in most cases constructed as multi-zone filters; the electric voltage is regulated for each zone in accordance with the collected dust volume in such a way that the highest separation power is achieved.

However, in a number of technical applications, the flue gas contains traces of ammonia. The latter may have been added deliberately, e.g., to condition the fly ash or to prevent corrosive effects, but it may also have originated in a preceding catalytic nitrogen removal system. Typical ammonia concentrations hereby range from one ppm to several multiples of ten ppm. Even E. B. Dismukes in "Conditioning of Fly Ash with Ammonia," Journal of the Air Pollution Ass. 25 (1975) 2, 152–156, has already pointed out that low ammonia concentrations in flue gas may lead to an aerosol formation in an electric filter. These aerosols have a negative effect on the corona discharges, particularly at the entrance to the filter. The flow densities in this area are reduced to values that are only fractions of those usually found in the absence of ammonia. This effect is known as "corona suppression" (or "corona quenching"). It has the result that—due to the lower separation rates—the electric filter must have larger volume dimensions.

BRIEF DESCRIPTION OF THE INVENTION

The invention is based on the task of creating an electric filter that has a high separation rate even for flue gases containing ammonia and in which practically no aerosol formation is able to occur in the entrance area of the filter.

According to the invention, this objective is realized in that, in order to remove the ammonia responsible for the aerosol formation and in order to suppress the corona in the entrance area of the electric filter, the spray and separation electrodes are wired in such a way that a positive corona forms there, while in the section(s) located downstream in the flow direction of the flue gases, the spray and separation electrodes are wired in such a way that a negative corona forms there.

The invention is hereby based on the following considerations:

The aerosols in the entrance area of an electric filter, through which the flue gases containing small amounts of ammonia pass, consist essentially of small particles of ammonium sulfate $(NH_4)_2SO_4$ and ammonium bisulfate $(NH_4)HSO_4$ formed by the following reactions:

$$NH_3+H_2SO_4 \rightarrow (NH_4)HSO_4 \quad (1)$$

$$NH_3+(NH_4)HSO_4 \rightarrow (NH_4)_2SO_4 \quad (2)$$

The initiating element of this reaction is the presence of sulfuric acid $H_2SO_4$ which again presupposes the presence of $SO_3$ and water. Water is always present in the flue gas and in adequate concentrations (typically 5–10%).

$$SO_3+H_2O \rightarrow H_2SO_4 \quad (3)$$

In contrast, only traces of $SO_3$ are contained in the flue gas. It is, however, formed under the action of the corona discharge, which, among other things, results in the formation of OH radicals, via an intermediate product, $HSO_3$, from the $SO_2$ in the flue gas:

$$SO_2+OH+M \rightarrow HSO_3+M \quad (4)$$

M stands hereby for a (third) collision partner, e.g., a third molecule or a third particle surface. $HSO_3$ is then converted in a very rapid reaction in the presence of oxygen to $SO_3$:

$$HSO_3+O_2 \rightarrow SO_3+H_2O \quad (5)$$

The point in the electric filter where the formation of this OH radical takes place is now especially important. It is known that in the active discharge zone—i.e., where the charge carriers are generated—excited atoms and molecules occur only directly next to the active electrode (spray electrode). The transport of the charge to the other electrode is brought about by unipolar ions. This zone, called an "ion drift region" in the literature, fills practically the entire space between spray and separation electrodes.

Technically constructed electric filters regularly operate with a negative corona (see Dubbel, at the cited place), i.e., the ion drift region contains only negative ions. OH radicals, in contrast, are formed primarily by electrons, positive ions, and other excited species:

$$e+H_2O \rightarrow e+H+OH \quad (6)$$

$$H_2O^+ + H_2O \rightarrow H_3O^+ + OH \quad (7)$$

$$OH^+ + H_2O \rightarrow H_2O^+ + OH \quad (8)$$

$$N_2^+ + H_2O \rightarrow H_2O^+ + N_2 \quad (9)$$

$$N_2^* + H_2O \rightarrow OH + N_2 + O \quad (10)$$

$$O(^1D) + H_2O \rightarrow OH + OH \quad (11)$$

In the case of the negative corona, these species are present only in the active discharge zone, directly next to the spray electrode. This means that OH radicals and the mentioned aerosol particles are formed in high concentrations at the spray electrode and are active for the production of charged particles, and there impair the formation of the corona discharges. In serious cases, this may result in a strong reduction of the corona flow for a given voltage ("corona quenching").

If the spray and separation electrodes are now connected to the high-voltage source in the entrance area of the electric filter in such a way that a positive corona is formed there, the undesired ammonia is already eliminated there under the influence of the positive corona. This results in an ion drift region with positive ions which almost completely fills the space between the spray and separation electrodes and, in this manner, produces OH radicals according to reaction equations (7) to (9) in the entire volume, which then results in a formation of ammonia salts with reduced concentration in this volume.

This removes the undesired ammonia responsible for the aerosol formation from the entrance area of the electric filter, and the effect of the corona suppression due to the reduction in the aerosol concentration is reduced, and is, additionally, due to the quantitative removal of the $NH_3$, limited to the entrance area.

As a result, the entrance area of the electric filter also contributes to the optimum separation of particles. In practical terms, this means that this area that takes up from one-fifth to one-quarter of the entire filter volume becomes fully effective, thus resulting in a significant reduction in dimensions.

The invention can be realized both for new installations and existing electric filter systems. The arrangement and suspension of the spray electrodes with a positive corona in the entrance part of the electric filter hereby corresponds approximately to that for negative coronas. Only a separate supply of the spray electrodes must be provided. It is also possible that a filter arrangement with a positive corona is positioned so as to precede a standard electric filter (with a negative corona) as a self-contained component, so that its separation power can be reduced by 20% and more.

The invention is described below using an exemplary embodiment that is shown in the drawing.

BRIEF DESCRIPTION OF THE DRAWING

The only figure of the drawing shows a schematic cross section through an electric filter with a positive corona in the entrance area.

DETAILED DESCRIPTION OF THE PREFERRED EMBODIMENT

Figure 1:
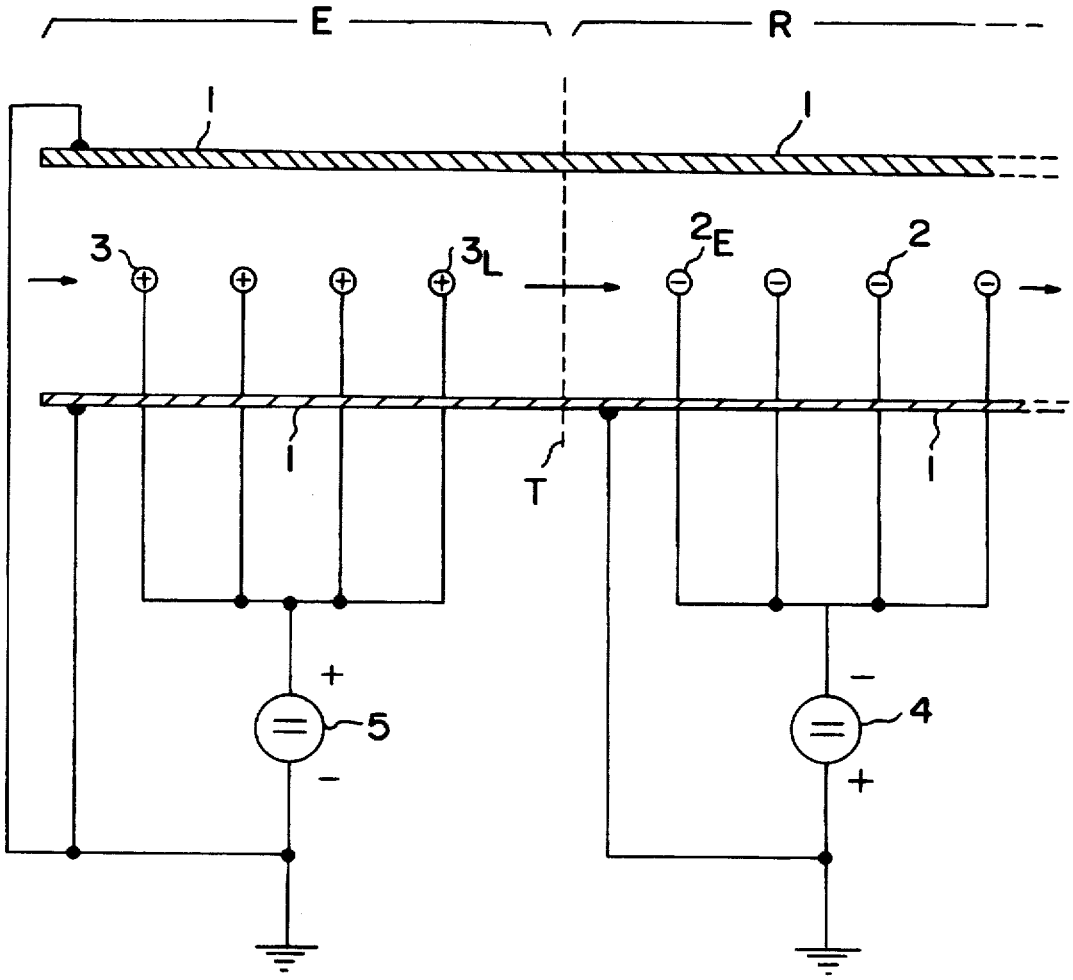

In the drawing, a number of first and second spray electrodes 2 or, respectively, 3, are arranged symmetrically between two plate-shaped, metallic separation electrodes 1 that extend parallel to each other. The first spray electrodes 2 are connected to the negative pole of a first direct voltage source 4. The second spray electrodes 3 are connected to the positive pole of a second direct voltage source 5. The positive pole of the first, and the negative pole of the second direct voltage source are each connected to the separation electrodes 1 which are usually connected to earth potential. Both direct voltage sources supply voltages in the magnitude of several 10,000 Volts. Preferably, the second spray electrodes 3 are supplied with intermittent direct current in order to generate a sufficiently stable positive corona, which can be achieved with an adjustable pulse frequency and/or pulse length.

The spray electrodes 2,3 are constructed in the known manner and consist, e.g., of point-equipped wires or wire twists, and are held in a frame (not shown).

Together with the separation electrodes 1 facing them, the second spray electrodes 3 form the entrance area E of the electric filter. The adjoining remaining area R is approximately four to five times as long or large in terms of length and separation volume. The distance between the last spray electrode $3_L$ with a positive corona in the flow direction of the flue gas—symbolized by arrows—and the first spray electrode $2_E$ with a negative corona in the flow direction of the exhaust gas is somewhat larger hereby, typically 50 cm, than the distance between the spray electrodes of each group, since a potential difference of double the nominal voltage acts between them.

The separation line T in the drawing indicates that the entrance area with spray electrodes 3 with a positive corona can also be executed as a self-contained component that can precede the electric filter (with a negative corona).

If the high voltage is turned on, the initially described chemical reactions will then take place in the filter path between the separation electrodes 1.

I claim:

1. An electric filter for flue gases containing ammonia, comprising:

surface separation electrodes;

a high voltage source; and first and second spray electrodes connected to the high-voltage source and arranged between the surface separation electrodes, wherein, in order to remove ammonia from the flue gases that is responsible for aerosol formation in an inlet area of the electric filter and in order to suppress a corona in the inlet area of the electric filter, the second spray electrodes and the separation electrodes are disposed upstream, in a flow direction of the flue gas, from the first spray electrodes and disposed near an inlet area of the electric filter and are wired such that a positive corona forms, and the first spray electrodes and the separation electrodes are disposed downstream in the flow direction of the flue gas and are wired such that a negative corona forms.

2. The electric filter as claimed in claim 1, wherein the high voltage source includes a first and a second direct voltage source, and the first spray electrodes are connected to a negative pole of the first direct voltage source, the second spray electrodes are connected to a positive pole of the second direct voltage source and the separation electrodes are connected to one of a positive pole of the first direct voltage source or a negative pole of the second direct voltage source.

3. The electric filter as claimed in claim 2, wherein at least the second direct voltage source provides an intermittent current.

* * * * *